US006897785B2

(12) United States Patent
Corbus

(10) Patent No.: US 6,897,785 B2
(45) Date of Patent: May 24, 2005

(54) CHARGING STATION FOR PAGERS WITH NIGHT LIGHT

(76) Inventor: Franklin Corbus, R.R.2 Box 460, Mt. Home, ID (US) 83647

( * ) Notice: Subject to any disclaimer, the term of this patent is extended or adjusted under 35 U.S.C. 154(b) by 80 days.

(21) Appl. No.: 10/421,443

(22) Filed: Apr. 21, 2003

(65) Prior Publication Data

US 2004/0207533 A1 Oct. 21, 2004

(51) Int. Cl.[7] ..... G08B 21/00

(52) U.S. Cl. ..... 340/636.1; 340/641; 320/115; 362/183

(58) Field of Search ..... 340/636.1, 641, 340/7.63, 7.32; 320/DIG. 18, DIG. 19, 113, 115; 455/573; 362/183; 315/129

(56) References Cited

U.S. PATENT DOCUMENTS

| | | | | | |
|---|---|---|---|---|---|
| 4,258,291 | A | | 3/1981 | Scott et al. | 315/156 |
| 4,344,071 | A | | 8/1982 | Allen | 340/566 |
| 4,422,018 | A | | 12/1983 | Bailey | 315/360 |
| 4,433,362 | A | | 2/1984 | Ban | 362/86 |
| 4,476,554 | A | | 10/1984 | Smith et al. | 367/197 |
| 4,630,248 | A | | 12/1986 | Scott | 367/197 |
| 4,690,242 | A | | 9/1987 | Mark | 181/0.5 |
| D294,180 | S | | 2/1988 | Johnson et al. | D26/93 |
| 5,587,645 | A | | 12/1996 | Sciammarella et al. | 320/2 |
| 5,592,066 | A | * | 1/1997 | Fan | 320/113 |
| 5,822,546 | A | * | 10/1998 | George | 710/303 |
| 6,034,505 | A | * | 3/2000 | Arthur et al. | 320/113 |
| 2003/0199183 | A1 | * | 10/2003 | Wangenheim et al. | 439/100 |
| 2004/0127264 | A1 | * | 7/2004 | Eisenbraun | 455/573 |

FOREIGN PATENT DOCUMENTS

| | | | | |
|---|---|---|---|---|
| GB | 2260040 | * | 3/1993 | H02J/7/00 |
| JP | 2004-55361 A | * | 4/2002 | F21V/33/00 |
| JP | 2004-55361 A | * | 2/2004 | F21V/33/00 |

* cited by examiner

*Primary Examiner*—Jeffery Hofsass
*Assistant Examiner*—Jennifer Stone
(74) *Attorney, Agent, or Firm*—Pedersen & Co., PLLC; Ken J. Pedersen; Barbara S. Pedersen

(57) ABSTRACT

A recharging stand for pagers with a night light designed for the particular needs of emergency response personnel such as firemen. The light is preferably activated only in response to a signal to the pager. Also, the light is a focused beam that is adjustable in direction as needed by the user. Optionally, the light may be attached to a timer, which deactivates the light after a set amount of time since activation has lapsed.

13 Claims, 1 Drawing Sheet

CHARGING STATION FOR PAGERS WITH NIGHT LIGHT

BACKGROUND OF THE INVENTION

1. Field of the Invention

This invention relates generally to the field of pagers, and more particularly, to battery chargers for charging a pager's battery.

2. Related Art

Firefighters and other emergency personnel are often summoned from their homes in the middle of the night by means of a pager. They must dress and leave as quickly as possible, preferably without unduly disturbing other family members. Night is typically the only time that the pager can be recharged.

There are a number of devices in the prior art that include battery rechargers, emergency lights, timed lights, or sound or motion detectors. However, none of these devices includes a combination of features that the inventor considers optimum for emergency personnel.

Sciammarella, et al. (U.S. Pat. No. 5,587,645) discloses a battery charger for a cordless telephone that includes a night light. The light is activated when AC power is lost and a phototransistor detects that the ambient light is below a preset level. The purpose of the light is to help the user locate the phone during low light conditions.

Scott, et al. (U.S. Pat. No. 4,258,291) discloses an emergency light that is activated when the signal of a smoke alarm is detected. It includes a diffuse light source designed to illuminate an entire room or passageway to facilitate evacuation during a fire.

Allen (U.S. Pat. No. 4,344,071) discloses a system for actuating household lighting in response to sound or movement within a room. It also includes a timer, which turns the light off after a preselected amount of time has elapsed.

Smith, et al. (U.S. Pat. No. 4,476,554) discloses a sound actuated light switch. It activates a light upon detection of a sufficiently intense audio signal. The light is turned off after a preset amount of time has passed.

Scott (U.S. Pat. No. 4,630,248) discloses a system for activating a lamp when an alarm or similar sound is detected. The system includes a light sensor that prevents the lamp from activating when the area the lamp is already illuminated. A manual on/off switch is also included.

No device in the prior art has all the precise features needed by emergency personnel. Thus, there is still a need for a pager recharger with a focused light source that is adjustable in space and direction and that is activated by a signal to the pager.

SUMMARY OF THE INVENTION

The invention is a recharging stand for pagers with a night light designed for the particular needs of emergency response personnel such as firemen. The light is preferably activated only in response to a signal to the pager. Also, the light is preferably a focused beam which is adjustable in direction as needed by the user. Optionally, the light may be attached to a timer, which deactivates the light after a set amount of time since activation has lapsed.

The preferred battery recharger for emergency personnel responds to a signal from the pager and automatically provides light solely in the area where the user dresses, without illuminating the entire room. The preferred light stays on long enough to give said person enough time to exit the house using said light and then shuts off automatically. This also saves considerable energy and prevents family members from having to get up to turn off the light. The invention, therefore, also prevents injuries from moving in the dark.

DETAILED DESCRIPTION OF THE INVENTION

Figure 1:
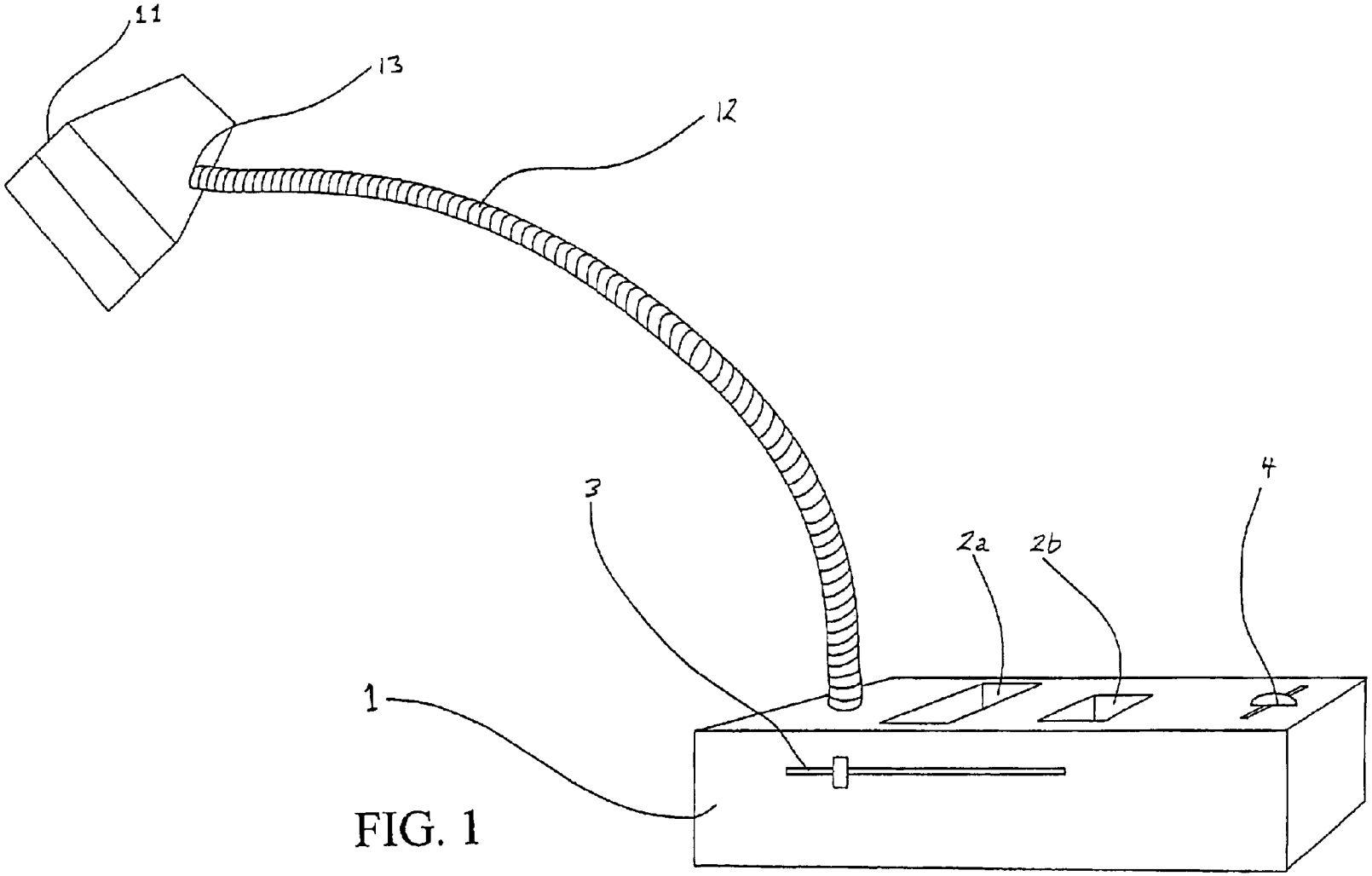
FIG. 1 is a perspective view of the preferred embodiment of the present invention.

Referring to the Figures, there is shown one embodiment of the invented recharging stand for pagers that is capable of detecting and responding to any signal to the pager. In the preferred embodiment, the battery recharging stand's response to a signal includes activating a light source.

As shown in FIG. 1, the preferred embodiment of the pager recharging stand includes a base 1 with one or more pager recharging sockets 2*a* and 2*b* for recharging different pager models. Although not required, the preferred embodiment includes an adjustable timer 3, which turns the light off after a set amount of time has elapsed, and a dimmer switch 4. The light source 11 is focused, and preferably the focus is adjustable between a narrow beam and a diffuse light. The light source 11 is supported by a flexible neck 12, which can be manipulated to aim the light source 11 in the desired direction. Also, the connection 13 between the light source 11 and flexible neck 12 may include a swivel to aid the user in aiming the light source 11. Alternative means for aiming/moving the light may be used, as will be understood by one of skill in the art after reading this Description.

The battery recharger is powered by linking it to an AC power source (not shown). It is capable of detecting a signal to the pager, either through the electrical link used to charge the battery or by detecting the pager's response to a signal, whether the response is an audio signal or vibration. In an alternative embodiment, the recharger produces an audible signal when the beeper in use is a vibrating pager.

When the pager receives a signal, a light 11 is activated. No other light is required, but small lights indicating pager charging status could optionally be included. The light is preferably focused so that it illuminates only a small area. It is preferably adjustable in direction and space so that the user can control what area is illuminated by the light source 11. Optionally, the brightness of the light source 11 may be adjusted. This feature is important in many embodiments, as a primary objective of the invention is to create light that will not unnecessarily disturb the user's sleeping partner or other family members. Furthermore, the preferred embodiment includes a timer that turns the light source 11 off after a set amount of time has elapsed. This set amount of time is preferably selected by the user. The electrical/electronic components necessary to accomplish the preferred performance of the invention may be designed by one of skill in the art after reading this Description.

Although this invention has been described above with reference to particular means, materials, and embodiments, it is to be understood that the invention is not limited to these disclosed particulars, but extends instead to all equivalents within the scope of the following claims.

I claim:

1. A pager recharging stand with:

a power source;

a port for receiving said pager;

a system for delivering DC current to said pager through said port such that rechargeable battery of said pager is charged;

a light source that produces a focused beam, which said light source is adjustable in space and in direction; and a system for detecting when said pager receives a signal, which system actives said light source when said signal is detected.

2. The pager recharging stand of claim 1 with no additional lights of any kind.

3. The pager recharging stand of claim 1 with a timer that shuts the light source off after a set period of time since the light source was activated has elapsed.

4. The pager recharging stand of claim 3 wherein said set period of time for said timer is adjustable.

5. The pager recharging stand of claim 1 with a system for manually adjusting the brightness of said light source.

6. The pager recharging stand of claim 1 wherein said focused beam of light is adjustable in focus.

7. The pager recharging stand of claim 1 with one or more ports where said ports are adapted to accommodate different models of pagers.

8. The pager recharging stand of claim 1 wherein said power source is an AC power source, which is connected to said pager recharging stand with a standard electrical cord.

9. The pager recharging stand of claim 1 with a system for emitting an audible signal when said signal to pager is detected.

10. The pager recharging stand of claim 9 wherein said audible signal has an adjustable volume.

11. The pager recharging stand of claim 9 with a timer that shuts said audible signal off after a set period of time has elapsed.

12. The pager recharging stand of claim 11 wherein said set period of time is adjustable.

13. The pager recharging stand of claim 9 wherein said audible signal may be turned off by the user.

* * * * *